US005326299A

United States Patent [19]

Jasinski

[11] Patent Number: 5,326,299

[45] Date of Patent: Jul. 5, 1994

[54] FLEXIBLE DISC TOY FOR SINGULAR AND MULTIPLE FLIGHTS AND BOUNCES

[76] Inventor: Gene M. Jasinski, 230 Renfaire Dr., Plantersville, Tex. 77363

[21] Appl. No.: 855,831

[22] Filed: Mar. 23, 1992

[51] Int. Cl.[5] ..... A63H 27/00

[52] U.S. Cl. ..... 446/46; D21/86

[58] Field of Search ..... 446/46–48; 273/424, 425, 428; D21/86, 85, 82

[56] References Cited

U.S. PATENT DOCUMENTS

| | | | |
|---|---|---|---|
| D. 266,014 | 8/1982 | Wittman | 446/46 X |
| 2,002,631 | 5/1935 | Fiondella | 273/428 |
| 4,115,946 | 9/1978 | Vukmirovich | 446/46 X |
| 4,132,030 | 1/1979 | Lehman | 446/46 |
| 4,253,672 | 3/1981 | Milzoff et al. | 273/424 |

*Primary Examiner*—Mickey Yu

[57] ABSTRACT

An aerodynamic flexible flying and bouncing disc (10) toy that is lightweight and fits in a pocket, having an equiangular pentagonal central portion (12) consisting of two sheets (12t, 12b ) of fabric material whereby printing and dyeing may be impressed thereon, or a single sheet central portion (112) of flexible plastic material whereby various images and colors may be impressed therein, which retains five individual bouncing spherical weights (16) of plastic or rubber material of equal heft and size at equal proximity to the main body when in rotation and subsequent deceleration by means of a connecting nylon cord (14), which is secured in position by a flexible plastic retainer (18) or alternate central portion (112) of alternate disc (110). This is done to colorfully provide an efficient flexible disc (10, 110) of varying flight and bounce capabilities, which can be smoothly tossed, alone or in plural, and easily caught, alone or in plural.

18 Claims, 3 Drawing Sheets

FIG. 1
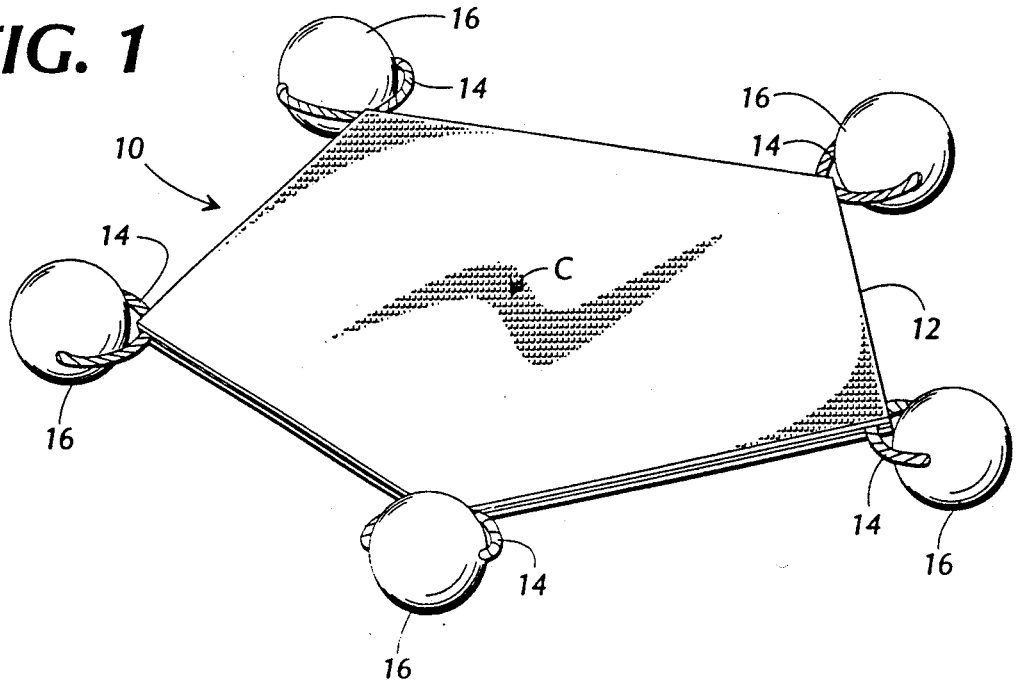
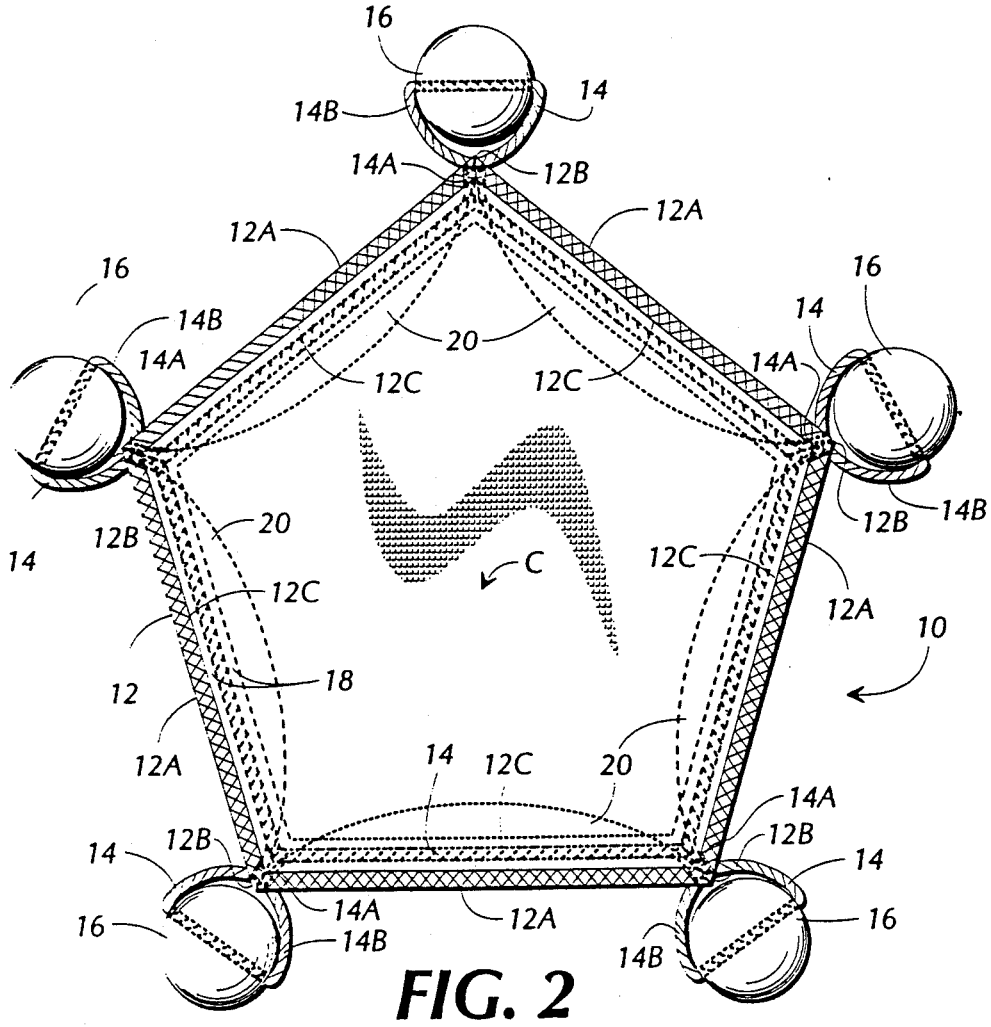
FIG. 2

FLEXIBLE DISC TOY FOR SINGULAR AND MULTIPLE FLIGHTS AND BOUNCES

BACKGROUND

1. Field of Invention

The present invention generally relates to flying disc toys, specifically to an improved flexible flying toy, which has greater stability when flown or rebounded, by itself or in plural, and is readily collapsible for easy catches and pocketability.

2. Description of Prior Art

After a quarter of a century of popularity the flying disc has become a permanent fixture in modem recreational sporting. The "Frisbee", manufactured by the Wham-O Manufacturing Company of San Gabriel, Calif. and disclosed and claimed in U.S. Pat. No. 3,359,678 issued to Edward E. Headrick on Dec. 26, 1967, is the most familiar of flying discs. It is made of a relatively rigid plastic material and has a recessed undersurface which curves down into the outer rim. While this disc can achieve relatively long distance flights in a rotating aerodynamically stable manner, and rebounds off the ground for trick maneuvers, the rim of the disc can scrape the skin of the fingers when thrown and jam these fingers when miscaught. Should the disc miss its target entirely and carom off of the ground the receiver of the catch may be sent scrambling in full circles to retrieve the disc. Neither can a plural of the disc be handily gathered for multiple tosses.

While a safer, stackable flying disc, known as the "Flippy Flyer", U.S. Pat. No. 3,710,505 issued to Carl J. Linenfelser on Jan. 16, 1973, may be softer and more flexible these same shock absorbing qualities inhibit the ability of the disc to rebound off of the ground. The "Flippy Flyer" cannot compare with the distance or stabilized control of flight as the "Frisbee". The downward curving rim, which is believed to give the "Frisbee" airfoil capability, is less pronounced in the flexible disc. Perhaps, this is why the flexible disc cannot achieve comparable feats.

U.S. Pat. No. 4,290,226 issued to Allen R. Stauffer on Sep. 22, 1981 has all the positive aspects of the "Flippy Flyer" and loosely approximates the shape of the "Frisbee" rim, and hence, stable flight characteristics. However, this flexible disc does not rebound or achieve great flight distance, since it is primarily an indoor toy.

While the resilient disc of U.S. Pat. No. 4,944,707 issued to David E. Silverglate on Jul. 31, 1990 does bounce and have reasonable flight abilities, the bounce occurs only when the disc is tossed perpendicular to the planal surface, which drastically limits the disc's continued maneuvering options. The disc bends minimally and cannot be stored in the pocket. Neither are simultaneous multiple tosses practical, because the disc tends toward swift and widely seperate trajectories and does not readily conform to the grasp of the hand. Like the "Frisbee" the resilient disc can run off or in widening circles on the ground when the catch is missed.

The tremendous popularity and wide variety of flying discs created and being created attest to the fact that there is a continuing need for the art and its growth. A diverse, compact and efficient flying disc, which is physically challenging and visually appealing and can be utilized by the widest range of users would certainly find universal acceptance and patronage.

OBJECTS AND ADVANTAGES

The present invention incorporates the advantages of both rigid and flexible discs and eliminates their detrimental aspects and augments the art with heretofor unseen elements.

Thus, we have a flexible disc, preferably equiangular pentagonal in shape, that has a flat, thin central portion of relatively small heft, which is surrounded by a rim portion consisting of flexibly attached weights that are spaced apart at such a distance that a hand can fit on the planal surface between them, for smooth, unhindered release of a rotating toss.

The flight stabilization system of the disc preferably consists of round bouncing balls of equal weight, which are flexibly attached along the periphery of the central portion, at the five outermost points, to provide centrifugal balance when rotated and the means by which the collapsible central portion may be pulled taut and made flat and thin.

The thinness of the central portion allows the disc to have minimal drag for slicing through the air and attaining reasonably long flight distance.

The weights, therefore, can be relatively light, due to the efficiency of the invention's aerodynamic design, as indicated by the lessening of air drag.

The centrifugal stabilization system enables the disc to maintain balance and recover its shape after bouncing off of a planal surface.

A player can easily snag a catch, without fear of finger jamming, since the disc as a whole readily collapses to conform to the grasp of the hand. Also, the loosely attached light and elastic weights, which protrude from a totally flexible central portion of the rotated disc, provide a multiple of targets for outspread fingers to gather.

When the friction of the air decreases the forward and rotational momentum of the disc and gravity becomes the predominant force of the toss the balanced weights of the present invention continue to provide uniform tension between their peripheral points of attachment, as they shift from an outward centrifugal trend to a downward gravitation position. This causes the attached flexible central portion to form a peripheral series of arcs, whose inward extension toward the central axis produces an air baffling structure which also acts in conjunction with the emerging shape of a recession, similar to the recession in a "Frisbee". This recession collects the upsurging air throughout the central hub of the disc, for a combined structure that efficiently controls the descent of the present invention for catches and stable ground landings.

In as much as the recession of the "Frisbee" is said to be responsible for the airfoiling capability of the disc, so can the present invention be characteristically similar, particularly when thrown forward and at a slight pitch upward, which allows the onward rush of air to pump out a recess in the flexible central portion.

Because the invention is generally flat, with the weights being spaced far apart, a multiple of discs can be stacked and thrown to a plural of targets simultaneously.

DRAWING FIGURES

Further objects and advantages of the present invention will become apparent by reference to the following detailed specification and drawings depicting a preferred embodiment of the invention.

FIG. 1 is a perspective view of the invention.

FIG. 2 is an overview of the internal structure of the invention.

REFERENCE NUMERALS IN DRAWINGS

| | |
|---|---|
| 10 flexible flying and bouncing disc | 110 alternative disc |
| 12 central portion | 112 alternative central portion |
| 14 cord | |
| 16 weights | |
| 18 flexible retainer | |
| 20 folds | |

DESCRIPTION-FIGS. 1 to 4

Referring now to FIG. 1 there is shown a perspective view of a disc of this invention.

The general shape of the invention is essentially a disc 10. Despite substantially minimized surface area and peripheral length of the central portion 12 and the fragmented outer rim, which is the weights 16, the annular disc shape of the prior art is integrally maintained in the symmetry of line, angle and radius found in the equiangular pentagonal shape of the present disc 10. It is also found in the equal radii of the balanced spherical weights 16 of the outer rim in their proximity to the central axis C of the disc 10.

Figure 3:
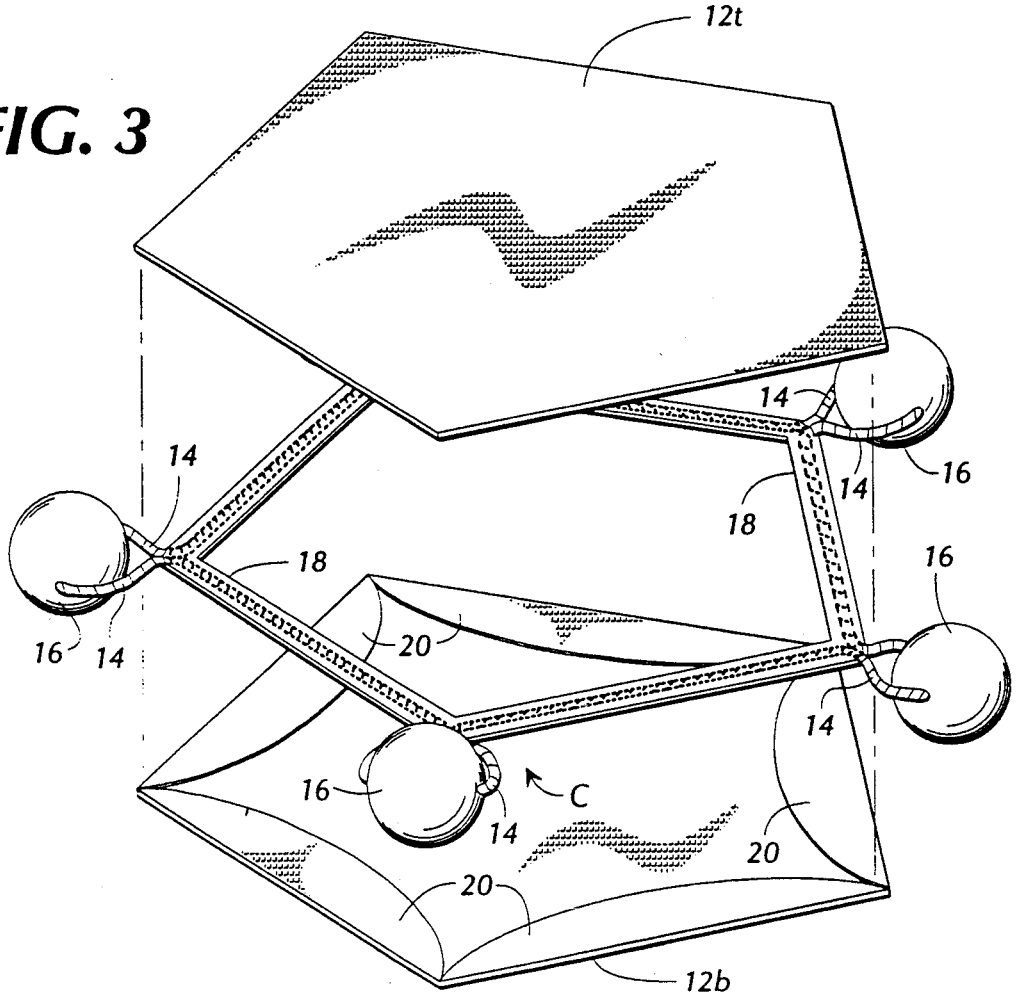
FIG. 3 is an exploded view of the invention.

Referring now to FIG. 2 there is shown an overview of the internal structure of the invention and the positioning of components. FIG. 3 shows an exploded view of the invention which better describes the construction of the disc 10.

The components of the disc 10 include a central portion 12 composed of two superimposed sheets **12*t*, 12*b* of flexible material, preferably a woven fabric, such as cotton. Such material readily accepts colorful dyes and printed line and letter patterns. However, the central portion 12** can consist of any material that can be repeatedly bent without fracturing, such as polyethelene, polypropylene, vinyl, rubber, leather, various plasticized materials, cardboard, paper, etc.

From a circle of fabric 6½" in diameter an equiangular pentagon is formed by folding in five equal parts from the perimeter toward the center, leaving five 3¾" sides along the newly formed perimeter and only five points across the original circumference line of the circle, which is the construct of each sheet **12*t*, 12*b* of the central portion 12. The folds 20 of the two sheets 12*t*, 12*b* are faced toward each other. The central portion 12 thus formed has a peripheral edge or perimeter made up of multiple substantially straight sides 12A, for example five in number, and multiple corners 12B, also for example five in number, connected to adjacent ones of the sides 12A. Between the sheets 12*t*, 12*b* is a flexible plastic retainer 18 in the configuration of an elongated continuous band or strip, alternatively made of rubber, vinyl, polyethelene, etc., which envelopes or encapsulates and positions the cord 14 that interconnects the surrounding outer rim weights 16 with the central portion 12**.

Being ¼" wide and 3/16" high and of rounded edges the retainer 18 runs ⅛" inward and parallel to the perimeter of the central portion 12. The retainer 18 envelops or encapsulates the cord 14 where the cord 14 runs a parallel course with the perimeter of the central portion 12, approximately ¼" inward. Between the retainer 18 and the perimeter of the central portion 12 is the border 12C reserved for sewing or hot welding the two sheets **12*t*, 12*b* of the central portion 12 and overlapping the segments 14A of the cord 14 located at the corners 12B of the central portion 12 which connect with portions 14B of the cord extending about and supporting the weights 16. Such connection between the sewn or welded border 12C and the cord segments 14A results in the retainer 18** being held in place.

The cord 14 is preferably of nylon weave 1/16" in diameter throughout. Many materials may be substituted in the cord 14, such as fibrous material, plastic, leather, vinyl, etc., as long as it is flexible at rest and break resistant under tension. The cord 14 must be of sufficient thickness to hold the central portion 12, retainer 18 and weights 16 together without slicing through them by being too thin.

The cord 14 is of a continuous length which, from its beginning in the retainer 18, is woven out of the central portion 12 and through a weight 16 and back in through the central portion 12 to the retainer 18 and so forth, until the circle is completed and the cord 14 is tied off to its opposite end. Little slack should be tolerated in the cord 14 between the weights 16 and the central portion 12.

The weights 16 are ½ ounce each and preferably ⅞" in diameter spheres. A 3/32" in diameter hole extends through the center of each weight 16 and is generally positioned perpendicular to each of the imaginary five spokes, which extend from the axis of the central portion 12 to its five farthest points.

The uniform roundness of the weights 16 makes the disc 10 relatively safe for the user while providing the means for predictable flight and bounce.

The preferred composition of the weights 16 is that of a most springy plastic, as is found in most common bouncing balls. Rubber, or as it is admixed with plastic, can be substituted as long as the ability to spring is retained as well as the ability to resist breaking or splitting.

When used strictly for the purpose of flight and not necessarily for rebounding or even measures of safety the weights 16 may consist of alternate materials, such as wood, metal, nylon, etc.

The shape of the weights 16 may be somewhat altered, since it is the equality and positioning of the weights 16 that is of greatest significance. An example of alternate shapes are fictional characters, pyramids, skulls.

The flatness of the central portion 12 and the wide positioning of the weights 16 provides a gripping space where the hand may be positioned on the central portion 12 of the disc 10 for the toss.

The flatness of the central portion 12 also permits a plural of discs 10 to be stacked high, if the edges of the discs 10 are slightly staggered, for tossing or for personal or merchandising storage.

Figure 4:
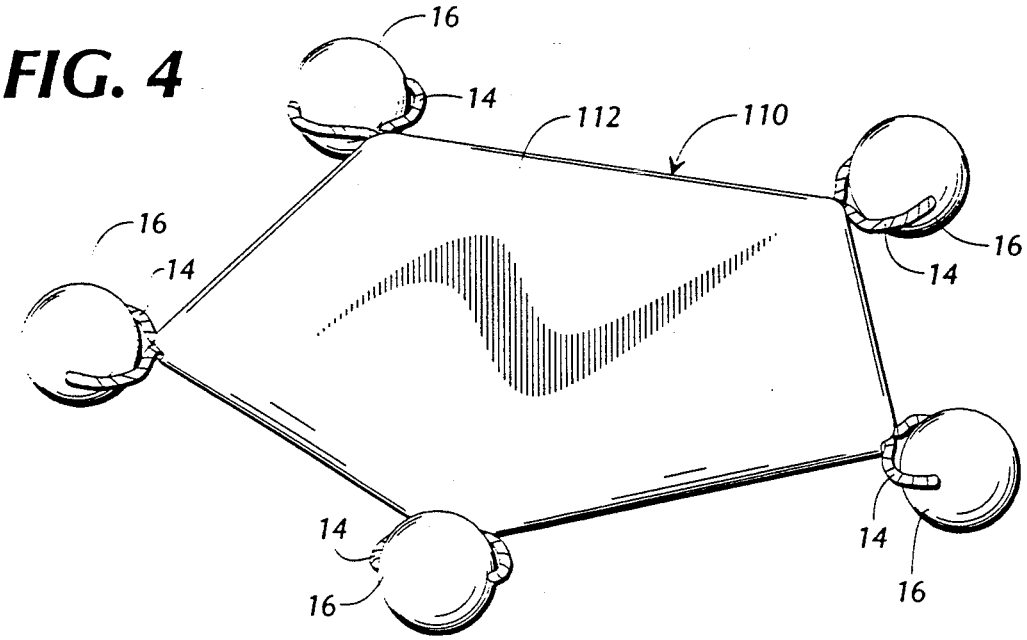
FIG. 4 is a perspective view of an alternative embodiment of the invention.

Referring to FIG. 4 is a perspective view of an alternate embodiment of the central portion 112 as embodied in an alternate disc 110. The alternate central portion 112 is comprised of a single sheet of injection molded flexible plastic, which, by enveloping the cord 14, maintains the position of the cord 14 and renders the seperate retainer 18 obsolete. A plastic alternate central portion 112 could also be shaped for visual display or specific aerodynamic response.

DESCRIPTION-FIGS. 1, 5, 6, 7

Referring to the perspective view of the disc 10 in FIG. 1 it will become apparent, that by placing our thumb on one sheet 12*t* and our forefingers on the other sheet 12*b* of the central portion 12 of the disc 10 and rotating a toss, with a forearm or sidearm flick of the wrist on a level plane parallel to the ground, the disc 10 can pass easily and without abrasion off the fingers and into the air. Whether the disc 10 then flies on or first rebounds off of the planal surface of the ground the receiver of the toss can pluck the disc 10 out of the air or allow the disc 10 to collapse into his/her hand.

When the flexible central portion 12 of the disc 10 is stretched flat in the initial stage of the toss, by the outward centrifuagal swing of the weights 16 in rotation, the disc 10 encounters minimal air drag, which aids in keeping the disc 10 level, stable and pointed toward its intended target. In the final stage of the flight this same flexible central portion 12 acts to collect air and create maximum air drag for decreasing the rate of descent. In the catch of the disc 10 the central portion 12 can collapse on impact, which permits the hand to easily grasp the disc 10, and in relative safety. The flexible retainer 18, which positions the cord 14 holding the outer weights 16, restricts that cord 14 from slipping and changing the position of the weights 16, which would create an imballance, as FIG. 3 illustrates.

Figure 5:
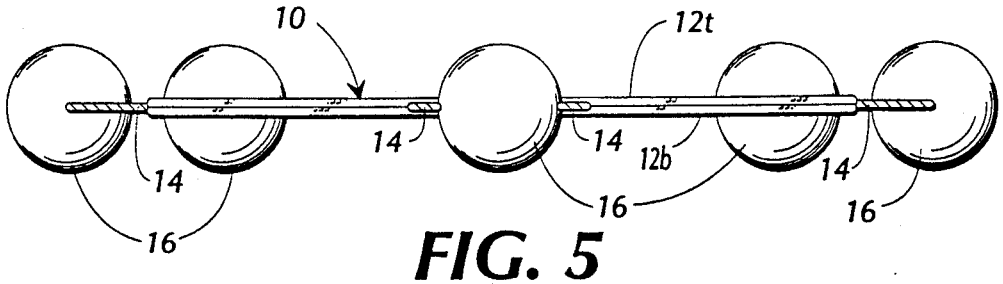
FIG. 5 is a side view of the invention in forward flight.

Referring to FIG. 5 the disc 10 is shown in a side view flying forward.

Figure 6:
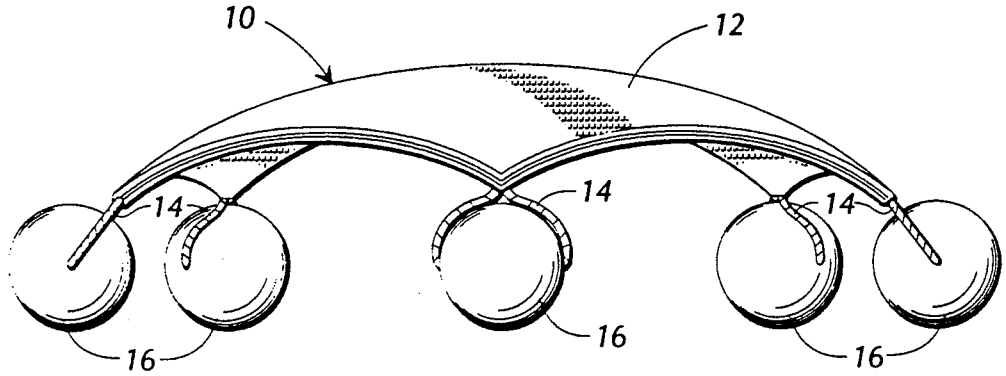
FIG. 6 is a side view of the invention in descent.

The cord 14 is essentially a leash which allows the weights 16, from their position just off the farther edges of the central portion 12, to move freely within the confines of their reach. This relationship enables the weights 16 to swing from their rotational function as flight stabilizers, a condition whereby centrifugal force directionalizes the weights 16 and the attached central portion 12 outward on a level flight plane, down to their stationary function as descent stabilizers, (See FIG. 6) a condition whereby the points of attachment to the central portion 12 are drawn down equally by gravitational force. The shifting of the weights 16 transforms the shape of the flexible central portion 12 from a flat pentagon into an inverted cup shape. The unequal side depths of this cup shape of the central portion 12 provides a channel, whereby the collected air in the center of the disc 10 can be baffled for a controlled descent.

Should a wobble in the flight of the disc 10 occur, which is caused by the misalignment of weights 16, the unfettered joint system may further act to stabilize the flight of the disc 10. Probably because the connecting line between the weights 16 is flexible the inertia, which develops out of the constant of centrifugal force in this case, can resolve the fluid tensions along this circumventing line or cord 14.

That the disc 10 has five sides is directly related to why there are five weights 16 in the preferred embodiment of the invention. It appears that five is the minimal number of weights 16 neccessary to achieve optimal flight stability. This probably occurs because the inertia, which keeps the weights 16 aligned in orbit, depends also on a number of weights 16 to demonstrate a constant. In other words, the greater the number of loosely attached weights 16 on the disc 10 the more defined is that constant and the less probable is any single weight 16 likely to influence the balance of the whole.

At the preferred size the space between the five weights 16 on the central portion 12 of the disc 10 provides enough surface area for almost any hand to fit within and experience the smooth releasing toss.

That all the weights 16 of the present invention are preferably identical spheres of equal heft is indicative of their primary function as flight stabilizers. The uniformity and balance of identical spheres limits the unpredictability of the disc 10 as it relates to the weights 16.

The springy roundness of the weights 16 promotes safety while providing the agency for a wide range of skillful maneuvers with the disc 10.

Figure 7:
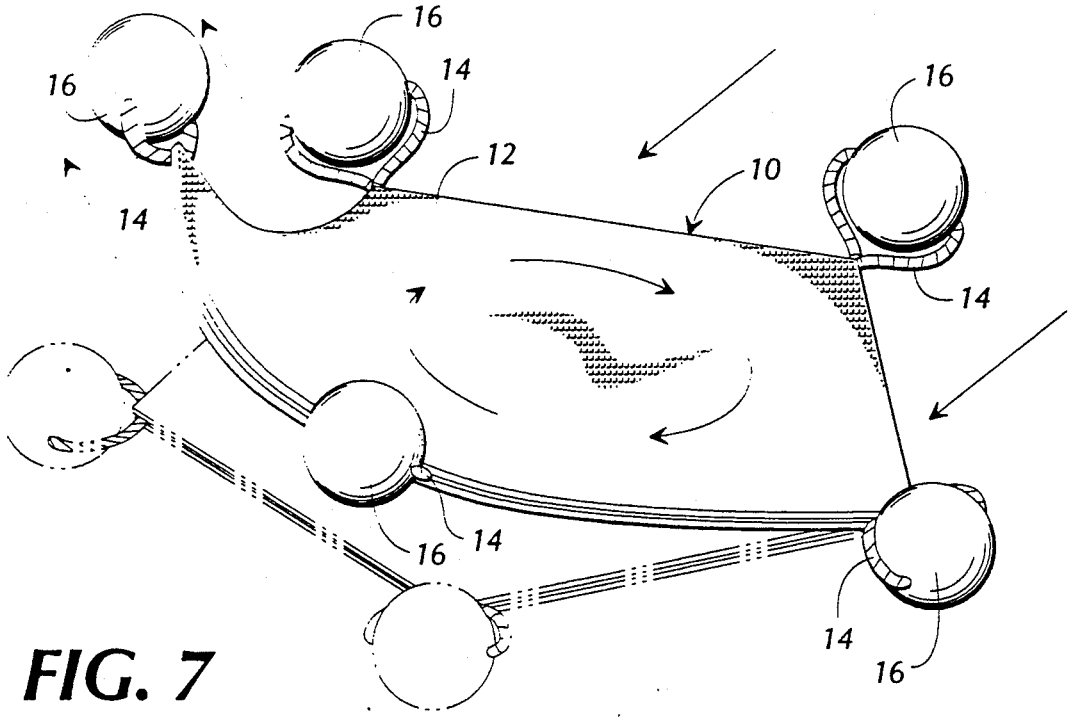
FIG. 7 is a perspective view of the invention when rotated and bounced.

When the weights 16 are in rotation and tossed at an indirect angle toward a solid planar surface, as in FIG. 7, the disc 10 can rebound because each individual weight 16 in the disc 10 can continue on into flight without disruption.

The weights 16, in their separateness, also creates the potential for a unique and pleasurable visual display, which looks optically similar to the effect of a strobe light on running water.

If the color, size, shape and heft of the weights 16 are varied the visual flight patterns and physical responces of the disc 10 can also be augmented. Added to the fact that a plural of discs 10 can be stacked on one another and flown in synchronized patterns further implies the vast potential the invention provides for expression.

A stack of discs 10 can seperate, when tossed and rotated, probably because each individual disc 10 in the stack can slice through the air and, thus, define its own course.

The flexibility of this amazing disc 10 allows the participant, after a time of play, to simply collapse the disc 10 into a small bundle for storage in the pocket.

SUMMARY, RAMIFICATIONS AND SCOPE

Thus, the reader will see the newly invented flying and bouncing disc is the most versatile of all the prior art, retaining the best elements of each while adding capabilities heretofore unseen.

The disc is lightweight, flexible, flattened and dynamically balanced for smooth throwing and effortless catches by an exceptionally wide range of people. It provides new challenges for the skilled who would enjoy the bounce and multiple flight capabilities. Even the casual observer can ogle at the colorful and varied flights of the disc.

For all this ease of control, challenging maneuverability and visual expressiveness the present invention suprisingly compacts to fit within a shirt pocket.

Inexpensive imaginative toys are within everyone's desire and reach.

Although the description above contains many specifics, these should not be construed as limiting the scope of the invention but as merely providing examples of some of the presently preferred embodiments. For example, the basic shape of the disc may be triangular, square, hexagonal, etc., and can be formed to resemble characters, real and imaginary.

If the sides in the disc are even in number a plural of differently weighted sets can be substituted when the weights in each set are equal and placed alternately between the weights of the other sets.

The weights may vary in size to accentuate the bounce, in shape to characterize a theme, in color to enhance the visual expressiveness, in composition so that it might sound like a bell.

Thus, the scope of the invention should be determined by the appended claims and their legal equivalents, rather than by examples given.

I claim:

1. A pocket fitting, aerodynamically-shaped flexible flying toy which readily conforms to the hand in both throwing and catching modes and which, when rotated and simultaneously tossed on a plane relatively level to the ground, said toy will fly and land in a stabilized fashion, said toy comprising:

a) a substantially flat central portion of flexible material having a perimeter of equiangular polygonal shape defined by miltiple sides and miltiple corners connecting adjacent ones of said sides, said central portion having a surface area whose boundary is defined by a predetermined radius, for guiding the flight and descent of said toy, b) a plurality of weights of substantially equal heft, c) means for flexibly attaching said weights to said corners of said perimeter of said central portion between said sides thereof.

2. The flying toy in claim 1 wherein said weights are identically spherical, whereby said toy can achieve greater aerodynamic and stabilized flight.

3. The flying toy in claim 2 wherein said spherical weights are bouncing balls, whereby said toy can achieve dynamic stabilized rebounding off parallel or near parallel surfaces.

4. The flying toy in claim 1 wherein:

said central portion includes a pair of sheets being superimposed one above the other and attached together about respective peripheries thereof, each sheet being pentagonal in shape.

5. The flying toy in claim 4 wherein said weights are identical spheres, whereby said toy can achieve greater aerodynamic and stabilized flight.

6. The flying toy in claim 5 wherein said spheres are bouncing balls, whereby said toy can achieve dynamic stabilized rebounding off parallel or near parallel surfaces.

7. The flying toy in claim 1 wherein said central portion is a molded sheet, whereby said flexible attaching means is secured within said molded sheet.

8. The flying toy in claim 7 wherein said weights are identical spheres, whereby said toy can achieve greater aerodynamic and stabilized flight.

9. The flying toy in claim 8 wherein said spheres are bouncing balls, whereby said toy can achieve dynamic stabilized rebounding off parallel or near parallel surfaces.

10. The flying toy in claim 7 wherein said sheet is pentagonal in shape and said weights are five in number.

11. The flying toy in claim 10 wherein said weights are identical spheres, whereby said toy can achieve greater aerodynamic and stabilized flight.

12. The flying toy in claim 11 wherein said spheres are bouncing balls, whereby said toy can achieve dynamic stabilized rebounding off parallel or near parallel surfaces.

13. The flying toy in claim 1 further comprising:

d) means for securing said flexibly attaching means in a predetermined position to said central portion adjacent to and along said perimeter thereof.

14. The flying toy in claim 13 wherein said weights are identical spheres, whereby said toy can achieve greater aerodynamic and stabilized flight.

15. The flying toy in claim 14 wherein said spheres are bouncing balls, whereby said toy can achieve dynamic stabilized rebounding off parallel or near parallel surfaces.

16. The flying toy in claim 13 wherein said flexibly attaching means is a flexible cord extending about said perimeter of said central portion and having flexible portions extending outwardly from said corners of said perimeter and connected to and flexibly supporting said weights.

17. The flying toy in claim 16 wherein said securing means is an elongated continuous flexible retainer member enveloping and encapsulating said flexible cord and being disposed along said perimeter of said central portion.

18. The flying toy in claim 1 wherein said flexibly attaching means is a flexible cord extending about said perimeter of said central portion and having flexible portions extending outwardly from said corners of said perimeter and connected to and flexibly supporting said weights.

* * * * *